US005110094A

United States Patent [19]

Kruse

[11] Patent Number: 5,110,094

[45] Date of Patent: May 5, 1992

[54] B-SHAPED STRUCTURAL MEMBER AND FASTENING SYSTEM

[75] Inventor: George D. Kruse, Dallas, Tex.

[73] Assignee: PPA Industries, Inc., Dallas, Tex.

[21] Appl. No.: 578,954

[22] Filed: Sep. 7, 1990

[51] Int. Cl.[5] ..... E04B 1/38; E04H 17/02; E04H 17/14

[52] U.S. Cl. ..... 256/47; 256/48; 256/DIG. 5; 52/711

[58] Field of Search ..... 256/47, 48, DIG. 5; 52/361, 362, 363, 711, 372, 373, 374, 364

[56] References Cited

U.S. PATENT DOCUMENTS

| | | | |
|---|---|---|---|
| 451,461 | 5/1891 | Darnell . | |
| 762,902 | 6/1904 | Haines . | |
| 772,662 | 10/1904 | Mallory . | |
| 862,928 | 8/1907 | Myers . | |
| 1,187,280 | 6/1916 | Dodds . | |
| 1,190,749 | 7/1916 | Freeze . | |
| 1,195,760 | 8/1916 | Young . | |
| 1,360,375 | 11/1920 | Dammann . | |
| 1,395,894 | 11/1921 | Beckwith . | |
| 1,405,994 | 2/1922 | Fisher | 52/711 |
| 1,454,649 | 5/1923 | Murton . | |
| 1,477,349 | 12/1923 | Hindmarsh et al. . | |
| 2,020,062 | 11/1935 | Jackson | 52/711 |
| 2,055,759 | 9/1936 | Venzie | 52/363 |
| 2,396,512 | 3/1946 | Johnson . | |
| 2,467,558 | 4/1949 | Kapnek | 52/364 |
| 2,630,890 | 3/1953 | Macomber . | |
| 3,022,044 | 2/1962 | Gugino . | |
| 3,023,660 | 3/1962 | Brown | 52/363 |
| 3,161,263 | 12/1964 | Stokes . | |
| 3,214,875 | 11/1965 | Slowinski et al. . | |
| 3,282,005 | 11/1966 | Birdwell . | |
| 3,332,189 | 7/1967 | Blatnik . | |
| 3,545,152 | 12/1970 | Knohl | 52/372 |
| 3,775,924 | 12/1973 | McClure, Jr. . | |
| 3,807,089 | 4/1974 | Senese . | |
| 3,972,110 | 8/1976 | Sasena . | |
| 3,985,343 | 10/1976 | Sasena . | |
| 4,119,302 | 10/1978 | Moroco et al. . | |
| 4,804,166 | 2/1989 | Makus . | |
| 4,867,421 | 9/1989 | Vernon . | |

FOREIGN PATENT DOCUMENTS

| | | |
|---|---|---|
| 2516144 | 12/1981 | France . |
| 84/02944 | 8/1984 | PCT Int'l Appl. . |

*Primary Examiner*—Michael Safavi
*Attorney, Agent, or Firm*—Lee, Mann, Smith, McWilliams, Sweeney & Ohlson

[57] ABSTRACT

A B-shaped structural member including a linearly extending back-wall section running substantially the entire length of the member, a first sidewall section and a second sidewall section, each sidewall section being integrally formed with and extending from a respective side of the back-wall section, a first front-wall section and a second front-wall section, each front-wall section integrally formed with the extending from respective sidewall sections, first and second inwardly turned flange sections integrally formed with and extending from respective front-wall sections, and a linearly extending slot defined intermediate the inwardly turned flanges. The ends of the inwardly turned flange sections provide engagement surfaces to grippingly receive a fastener which is inserted into the slot. The engagement surfaces of the inwardly turned flanges are configured to permit easy insertion of the fastener but to retard the disengagement of the fastener from the structural member. The B-shaped cross section of the structural member provides approximately equal bending strength about both neutral axes and also provides a high ratio of bending strength to weight per lineal foot.

5 Claims, 2 Drawing Sheets

10
Z
14
4
70
20
Z
20
70
3
18
70
16
3
4
18
10
12
18
18
18
22

B-SHAPED STRUCTURAL MEMBER AND FASTENING SYSTEM

BACKGROUND OF THE INVENTION

The present invention relates to structural members and in particular to structural members which have a slotted tubular cross section. Tubular members such as pipes have been found to be useful structural members as tubular members generally provide strong resistance to bending without requiring a large cross sectional area, thereby keeping the weight per lineal foot of the tubular member low. The weight per lineal foot of a structural member is very important and should be kept as low as possible. The weight, which corresponds to the amount of material used to form the member, is the primary factor which determines the cost of the member.

In certain applications such as for fence posts and top rails the bending strength of a member about its weakest axis controls the member's design. The American Society of Testing and Materials has published a specification designated as ASTM F669 which specifies a Group IV minimum bending strength of 37,200 inch-pounds (in-lb) for corner posts; 19,600 in-lb for line posts; and 7,100 in-lb for top rails used for heavy industrial fence. The requirements of ASTM F669 Group IV are not axis oriented and apply to all axes of a structural member. A member which has a significantly larger bending strength about one axis than another axis will have a larger weight per lineal foot than what is required and will therefore be costlier than need be. Circular tubes such as pipes have therefore traditionally been used in fence construction as they have equal bending strength about all axes. While the use of a fraction of a pound of extra material in one fence post or top rail does not sound particularly costly, when the number of fence posts and top rails used in applications such as along the sides of an interstate highway which stretches for miles are considered, that fraction of an extra pound becomes very costly.

Although tubular members provide good bending strength to weight ratios, tubular members are expensive to fabricate. The member must first be rolled from a flat sheet of metal into the desired shape. The longitudinal edges of the member must then be welded together and then the weld must be ground down. These and other fabrication steps which are required to produce a tubular member add to the cost of the member.

Tubular members such as pipes which have a continuous outer wall also present problems in making a connection to the tubular member. Fastening wires have typically been used to fasten fence fabric to fence posts and top rails. The fastening wire is typically bent around the post or top rail and then each end of the wire is fastened to the fence fabric by twisting the wire around the fabric. The fastening wire must be sufficiently thin and flexible so it may be bent and twisted as needed. This subjects the fastening wire to failure due to over-twisting, corrosion or overstressing at relatively low loads. The use of fastening wires is also a very costly and time consuming process when the total number of connections between the fence fabric and the fence posts and top rails are considered.

It has therefore been found to be desireable to manufacture and use a slotted tubular structural member for fence construction and in other applications, which member has a high bending strength to weight ratio, has approximately equal bending strength about its axes, is easily fabricated and provides a strong and simple means for securely fastening objects to the member. Slotted tubular members are shown in U.S. Pat. Nos. 762,902 and 4,867,421.

SUMMARY OF THE INVENTION

The present invention provides a slotted tubular structural member of unique cross section that can be easily formed from uncoated sheet steel or from precoated sheet steel, such as aluminized or galvanized steel. The structural member includes a generally B-shaped cross section having a linearly extending back-wall section extending substantially the entire length of the member, first and second sidewall sections integrally formed with and extending from respective sides of the back wall section, first and second front-wall sections integrally formed with and extending from a respective sidewall section, and first and second inwardly turned flange sections integrally formed with and extending from a respective front-wall section. The flange sections terminate in flange ends which are spaced apart to define a continuous longitudinally extending slot formed between the flange ends.

The flange ends are turned inwardly towards the center of the member and are disposed at an angle to one another to provide for the easy axial insertion of a fastener into the slot whereupon the flange ends will grip the fastener such that longitudinal movement of the fastener along the slot is prevented and any attempt at the axial withdrawal of the fastener results in a natural closing action which forces the flange ends towards one another thereby increasing the gripping pressure of the flanges upon the fastener and increasing the retention power of the structural member.

The unique B-shaped cross section of the structural member provides approximately equal structural properties about axes perpendicular to the back-wall section and the sidewall sections. The B-shaped cross section, although being a longitudinally open section, provides a greater ratio of bending strength to weight per lineal foot than that provided by circular tubular members having a continuous wall.

DESCRIPTION OF THE PREFERRED EMBODIMENT

Figure 1:
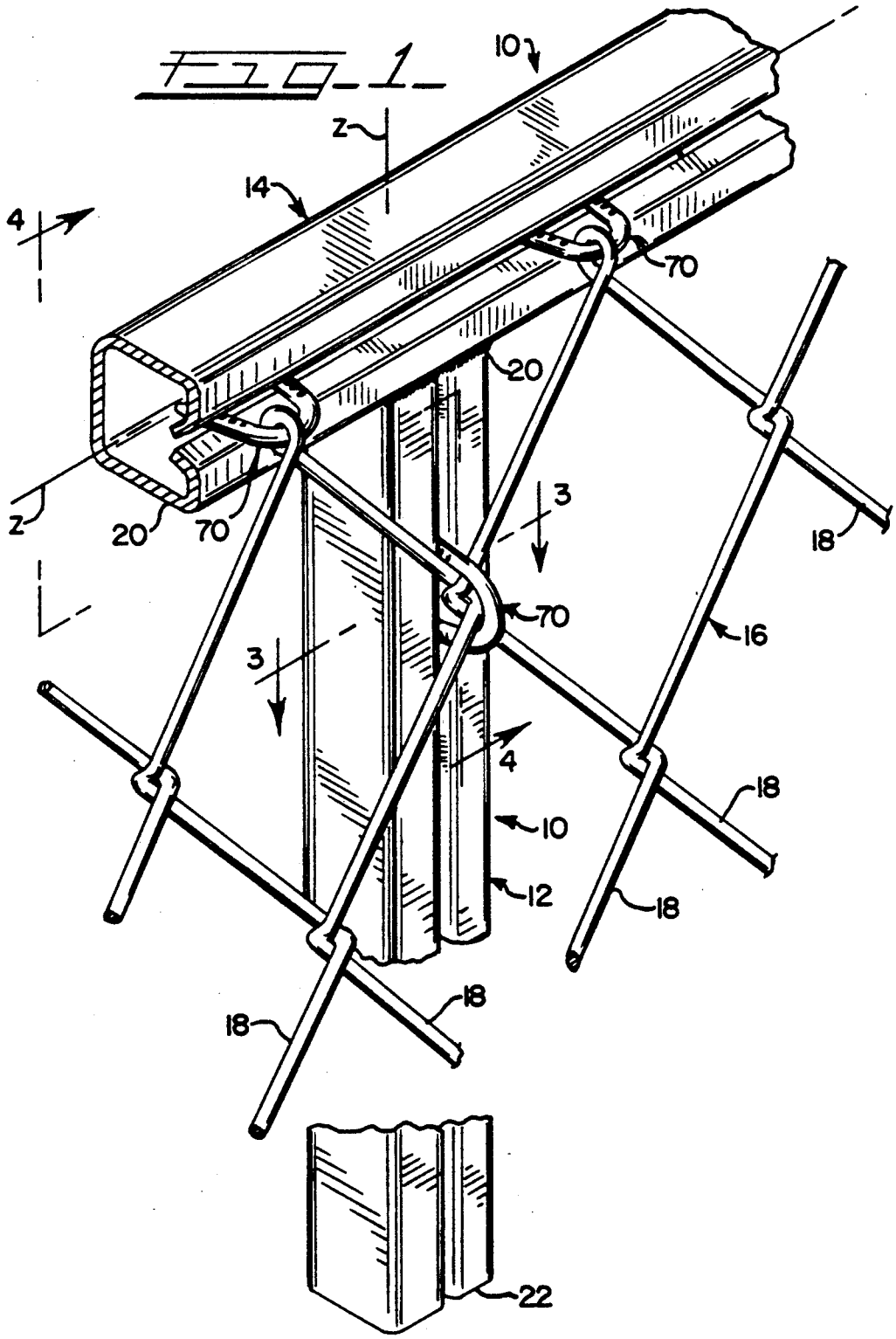
FIG. 1 shows the B-shaped structural member in use as both a post and as a top rail for supporting wire mesh fence fabric.

The B-shaped structural member 10 is shown in FIG. 1 in use as a post 12 and as a top rail 14. The post 12 and the top rail 14 are used to support a wire mesh fence fabric 16 which is comprised of a plurality of interwoven wires 18. The structural member 10 extends between a first end 20 and a second end 22 and is formed from a single integral strip of metal 24. The metal strip 24 may be cut from a larger sheet of metal and may be uncoated or may have a galvanized, aluminized or other coating.

Figure 2:
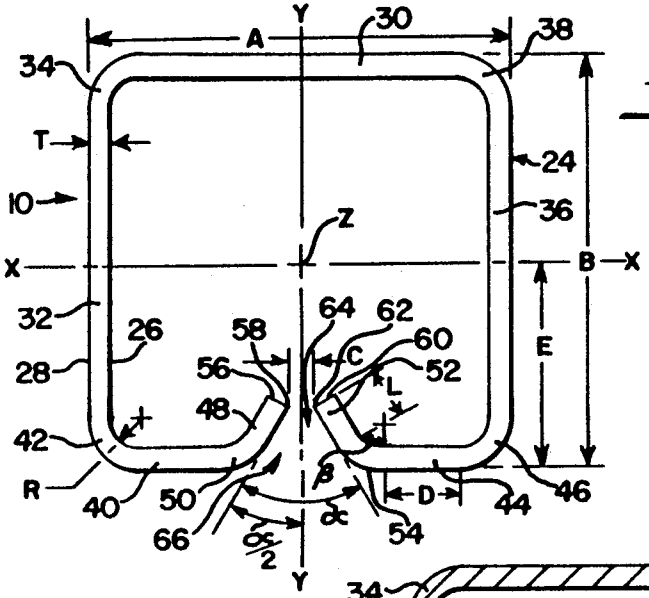
FIG. 2 is a top view of the B-shaped cross sectional configuration of the structural member.

The metal strip 24 is rolled into a B-shaped member 10 having an interior surface 26 and an exterior surface 28 which are spaced apart by a thickness T. The B-shaped member !0 includes a back-wall 30 which extends between the first end 20 and the second end 22 of the member 10. A first sidewall 32 is integrally joined to one side of the back-wall 30 by a rounded corner 34. A second sidewall 36 is integrally joined to the opposite side of the back-wall 30 by a rounded corner 38. The sidewalls 32 and 36 are spaced apart substantially parallel to one another and perpendicular to the back-wall 30. As shown in FIG. 2, the exterior surfaces 28 of the sidewalls 32 and 36 are spaced apart a distance A.

A first front-wall 40 is integrally joined to the first sidewall 32 by a rounded corner 42. A second front-wall 44 is integrally joined to the second sidewall 36 by a rounded corner 46. The front-walls 40 and 44 are substantially parallel to one another and to the back-wall 30. The exterior surface 28 of each front-wall 40 and 44 is spaced apart from the exterior surface 28 of the back-wall 30 by a distance B as shown in FIG. 2.

A first flange 48 is integrally joined to the first front-wall 40 by a curved section 50. A second flange 52 is integrally joined to the second front-wall 44 by a curved section 54. The first flange 48 terminates in a squared-off flange end 56 which includes a square corner 58. The second flange 52 terminates in a flange end 60 similar to the flange end 56. The second flange 52 includes a square corner 62.

The flange 48 is generally planar and extends a distance L between the curved section 50 and the flange end 56. The flange 52 is also generally planar and extends a distance L between the curved section 54 and the flange end 60. Each of the front-wall sections 40 and 44 extend a distance D respectively between the rounded corner 42 and the curved section 50 and between the rounded corner 46 and the curved section 54. Each of the curved sections 50 and 54 have an interior surface 26 which conforms to an arc of a circle of radius R which is rotated about the origin of the circle an angle $\beta$ which is preferably approximately 60°. Each of the rounded corners 34, 38, 42 and 46 have an interior surface 26 which conforms to an arc of a circle of radius R which is rotated about the origin of the circle an approximate angle of 90°.

As shown in FIGS. 1 and 2, the flanges 48 and 52 are inwardly turned toward the center of the member 10 such that the flanges 48 and 52 are disposed at an angle $\alpha$ to one another, wherein $\alpha$ is determined by the formula:

$$\alpha = 180^\circ - 2\beta$$

Therefore when $\beta$ equals the preferred angle of 60°, $\alpha$ will also equal 60°. The flanges 48 and 52 define a linear slot 64 which extends continuously between the first end 20 and the second end 22 of the member 10. The slot 64 has a width C measured between the corner 58 of the flange 48 and the corner 62 of the flange 52 which is preferably approximately 0.150 inch wide. The slot 64 has a V-shaped entryway 66.

As shown in FIGS. 1 and 2, the member 10 includes three mutually orthogonal neutral axes X, Y and Z. The X axis extends perpendicular to the sidewalls 32 and 36 and is spaced a distance E from the exterior surface 28 of the front-walls 40 and 44. The distance E is generally approximately equal to one-half of the distance B. The Y axis extends perpendicular to the back-wall 30 and midway through the slot 64 such that the member 10 is symmetrical about the Y axis. The Z axis extends longitudinally through the member 10 and extends through the intersection of the X and Y axes.

The B-shaped member 10 may be produced in a variety of sizes by varying the distances A and B, however the distance A should approximately equal the distance B. The thickness T of the member 10 may also be varied. The width C of the slot 64 and the length L of the flanges 48 and 52 will remain constant with the various different sizes of the member 10 to enable the same size fastener 68 to be utilized with all sizes of the member 10.

As an example, one preferred size of the B-shaped member 10 conforms to the following dimensions in inches:

| A | B | C | D | E | L | R | T | $\beta$ |
|---|---|---|---|---|---|---|---|---|
| 2.50 | 2.50 | 0.150 | 0.467 | 1.25 | 0.25 | 0.1875 | 0.125 | 60° |

A structural member 10 comprised of these dimensions will provide the following structural properties wherein M equals the allowable bending moment for a member 10 having a maximum yield stress of 55,000 pounds per square inch (psi):

| Mx | My | Area | lb./ft. |
|---|---|---|---|
| 49,579 in-lb. | 51,023 in-lb. | 1.14 $in^2$ | 3.89 |

As can be seen the bending strength of the member 10 about the X axis (Mx) is approximately equal to the bending strength of the member 10 about the Y axis (My). This particular size of member 10 yields a ratio of 12,745 in-lb of bending strength for every one pound per lineal foot of weight. A comparable sized circular tube having a 2.50 inch outer diameter and a wall thickness of 0.125 inch would provide a bending strength of 28,962 in-lb with a weight of 3.17 pounds per lineal foot resulting in a bending strength to weight ratio of 9136. It is therefore apparent that a circular tube may be replaced by an equally strong B-shaped member 10 which is smaller in external dimensions than the circular tube and which is also lighter in weight per lineal foot than the circular tube and thus less expensive.

A number of common types of fasteners 68 may be used with the B-shaped member 10 such as nails, screws and bolts. A preferred fastener 68 is a generally U-shaped staple 70 having a pair of spaced apart legs 72. The legs 72 are preferably angled away from each other at approximately 15°. Each leg 72 terminates in a wedge shaped tip 74 and preferably includes a plurality of transverse serrations 76.

Figure 4:
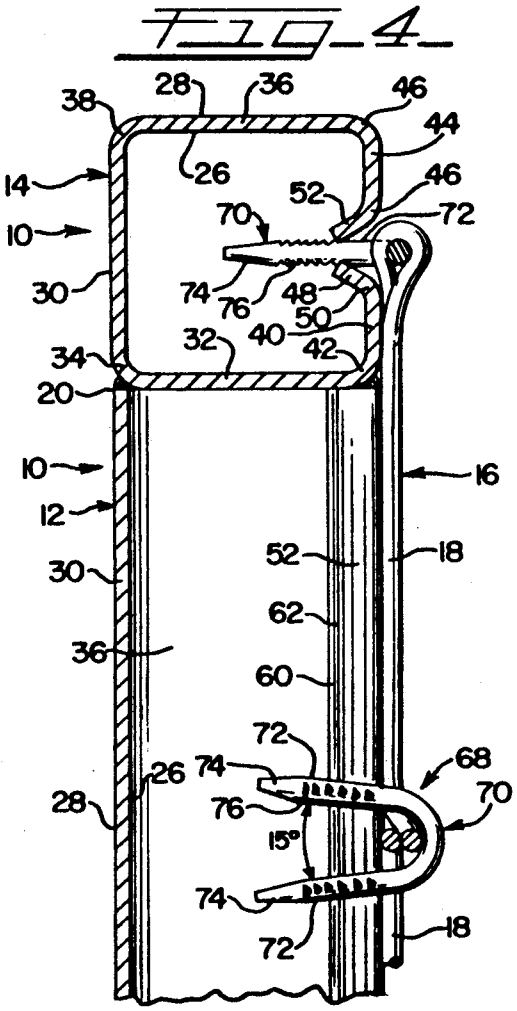
FIG. 4 is a side cross sectional view of the post and top rail taken along lines 4—4 of FIG. 1.
Figure 3:
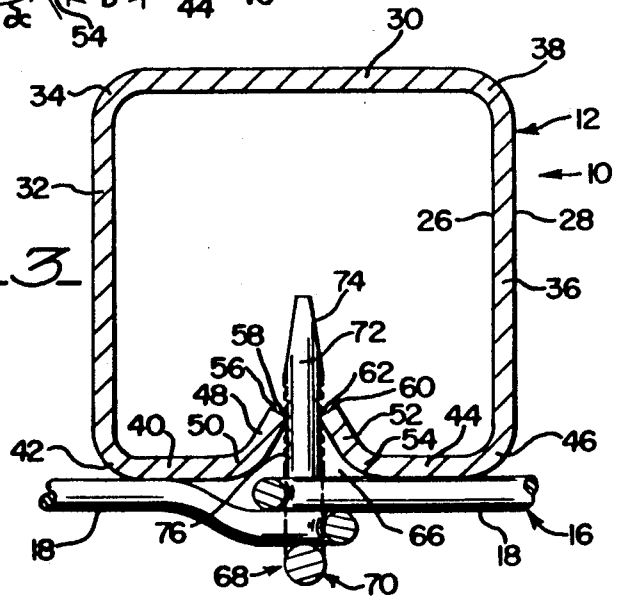
FIG. 3 is a top cross sectional view of the post taken along lines 3—3 of FIG. 1.

The legs 72 of the staple 70 are initially positioned in the entryway 66 of the slot 64. The legs 72 are wider than the slot 64, therefore as the staple 70 is axially forced into the slot 64, the wedge shaped tips 74 of the legs 72 will contact the corners 58 and 62 of the flanges 48 and 52 and will slightly spread the corners 58 and 62 apart widening the slot 64. The flange corners 58 and 62 will resiliently grip the legs 72 of the staple 70 such that the staple 70 becomes clamped between the flanges 48 and 52. Movement of the staple 70 within the slot 64 is prevented by the resilient clamping force exerted by the flange corners 58 and 62. The staple 70 will therefore securely fasten the fence fabric 16 against the B-shaped member 10 as shown in FIGS. 3 and 4. Although the B-shaped member 10 is shown and described herein as supporting fence fabric 16, the B-shaped member is equally capable of supporting various other objects such as barbed wire, wire strands, and signs.

The resilient clamping forces exerted upon the staple 70 due to the spreading of the slot 64 will cause the flange corners 58 and 62 to dig into the outer surface of the staple 70 thereby increasing the ability of the B-shaped member 10 to resist the removal of the staple 70. The serrations 76 on the staple 70 abut the flange ends 56 and 60 and act to lock the staple 70 within the slot 64 to provide further resistance to the withdrawal of the staple 70. An attempt to axially withdraw the staple 70 from the slot 64 will cause the flanges 48 and 52 to twist such that the front-wall 40 and the sidewall 32 will be spread further apart from the front-wall 44 and the sidewall 36. This spreading action will create a further resilient force which will attempt to return the B-shaped member 10 to its original configuration and results in an increase in the clamping forces exerted upon the staple 70. The clamping forces of the B-shaped member 10 upon the staple 70 will continually increase as removal pressure is increasingly exerted on the staple, thereby making removal of the staple 70 progressively more difficult as the force used in attempting to withdraw the staple 70 is increased. While disengagement of the staple 70 is highly resisted, the staple 70 may be easily inserted into the slot 64 in a minimal amount of time. Depending upon the size of the member 10, the staple 70 may be inserted by hand or with tapping from a hammer.

The B-shaped member 10 is rolled from an integral strip of metal 24 and does not require any seam welding or other fabrication steps. When the metal strip 24 is cut from a larger sheet of metal which is coated, the flange ends 56 and 60 will be uncoated. However, as the flanges 48 and 52 are inwardly turned, any rust which may form on the flange ends 56 and 60 would not be visible and would not detract from the aesthetic appearance of the member 10. The slot 64 creates an open section which allows for natural drainage and evaporation of moisture from the interior of the B-shaped member 10 to prevent internal corrosion.

Various features of the invention have been shown and described in connection with the illustrated embodiments of the invention, however, it must be understood that these particular arrangements merely illustrate, and that the invention is to be given its fullest interpretation within the terms of the appended claims.

What is claimed is:

1. A fence fastening and support system including:

a generally horizontally disposed top rail including a linearly extending back-wall section extending substantially the entire length of said rail; a first sidewall section and a second sidewall section, each said sidewall section integrally formed with and extending from a respective side of said back-wall section, said sidewall sections being generally perpendicular to said back-wall section; a first front-wall section integrally formed with and extending generally perpendicular from said first sidewall section and spaced from said back-wall section; a second front-wall section integrally formed with and extending generally perpendicular from said second sidewall section and spaced from said back-wall section; a first inwardly turned flange section integrally formed with and extending from said first front-wall section; a second inwardly turned flange section integrally formed with and extending from said second front-wall section, each said flange being inclined toward and spaced from each other; and a linearly and generally horizontally extending slot defined intermediate said inwardly turned flanges, said flanges each providing an engagement surface to grippingly receive fastener means therebetween; a plurality of generally vertically disposed posts, each said post including a linearly extending back-wall section extending substantially the entire length of said post; a first sidewall section and a second sidewall section, each said sidewall section integrally formed with and extending from a respective side of said back-wall section, said sidewall sections being generally perpendicular to said back-wall section; a first front-wall section integrally formed with and extending generally perpendicular from said first sidewall section and spaced from said back-wall section; a second front-wall section integrally formed with and extending generally perpendicular from said second sidewall section and spaced from said back-wall section; a first inwardly turned flange section integrally formed with and extending from said first front-wall section; a second inwardly turned flange section integrally formed with and extending from said second front-wall section, each said flange being inclined toward and spaced from each other; and a linearly and generally vertically extending slot defined intermediate said inwardly turned flanges, said flanges each providing an engagement surface to grippingly receive fastener means therebetween; means for connecting said rail to said posts; and a plurality of fasteners adapted to be inserted at spaced intervals along the length of said vertical slot and of said horizontal slot, each said fastener adapted to secure a portion of fence fabric to said post or rail, each fastener defining a serrated surface on its exterior, said engagement surfaces interlocking with said serrated surfaces of each said fastener to lock each said fastener to said post or rail such that removal of each said fastener is highly resisted while insertion of each said fastener requires a relatively small insertion force.

2. The fastening and support system of claim 1 wherein said top rail is connected to said posts such that front-wall sections of said top rail are flush with said front-wall sections of said posts.

3. The fastening and support system of claim 1 wherein said top rail and said posts are formed from individual single strips of steel of relatively uniform thickness.

4. The fastening and support system of claim 3 wherein said top rail and said posts include an aluminized coating.

5. The fastening and support system of claim 3 wherein said back-wall, sidewall and front-wall sections are imperforate.

* * * * *